US008317933B2

(12) United States Patent
Bilias

(10) Patent No.: US 8,317,933 B2
(45) Date of Patent: Nov. 27, 2012

(54) AUTOMATIC COIN-OPERATED OR ELECTRONIC CARD-OPERATED WASHING MACHINE AND DRYER FOR HELMETS

(76) Inventor: Ioannis Bilias, Varkiza (GR)

( * ) Notice: Subject to any disclaimer, the term of this patent is extended or adjusted under 35 U.S.C. 154(b) by 187 days.

(21) Appl. No.: 12/991,541

(22) PCT Filed: May 18, 2009

(86) PCT No.: PCT/GR2009/000030

§ 371 (c)(1),
(2), (4) Date: Nov. 8, 2010

(87) PCT Pub. No.: WO2009/138807

PCT Pub. Date: Nov. 19, 2009

(65) Prior Publication Data

US 2011/0056521 A1 Mar. 10, 2011

(30) Foreign Application Priority Data

May 16, 2008 (GR) ..... 20080100328

(51) Int. Cl.
*B08B 3/02* (2006.01)

(52) U.S. Cl. ..... 134/22.1; 134/22.18; 134/34; 15/21.1

(58) Field of Classification Search ..... 134/22.1, 134/22.18, 34; 15/21.1, 363
See application file for complete search history.

(56) References Cited

U.S. PATENT DOCUMENTS

| | | | | | |
|---|---|---|---|---|---|
| 1,707,605 | A | * | 4/1929 | Franko | 223/12 |
| 1,843,126 | A | * | 2/1932 | Geocares | 223/23 |
| 1,889,668 | A | * | 11/1932 | Kling | 223/23 |
| 1,889,761 | A | * | 12/1932 | Schlesinger | 34/58 |
| 1,903,489 | A | * | 4/1933 | Weitzman | 223/21 |
| 2,005,327 | A | * | 6/1935 | Schlesinger | 223/23 |
| 2,092,907 | A | * | 9/1937 | Chenier | 223/23 |
| 2,158,143 | A | * | 5/1939 | Ollinger | 223/23 |
| 2,268,721 | A | * | 1/1942 | Ossowsky | 134/50 |
| 4,115,891 | A | * | 9/1978 | Wills | 15/71 |
| 5,418,996 | A | * | 5/1995 | Chen | 15/36 |
| 6,553,687 | B1 | | 4/2003 | Leamon, Jr. | |

FOREIGN PATENT DOCUMENTS

| | | | |
|---|---|---|---|
| EP | 0167211 A | | 1/1986 |
| GB | 2 416 674 | * | 2/2000 |
| JP | 10-192798 | * | 7/1998 |
| JP | 2002-254043 | * | 9/2002 |
| JP | 2003-311225 | * | 11/2003 |
| WO | 01/66849 A | | 9/2001 |

* cited by examiner

*Primary Examiner* — Frankie L Stinson
(74) *Attorney, Agent, or Firm* — David A. Guerra

(57) ABSTRACT

An automatic coin—or electronic card—operated washing machine and dryer for helmets, which operates as an automatic and autonomous vending service machine and combines the quick and effective washing of a helmet with the protection of its parts and units and comprises a body (1), where the washing chamber (2) is located. The washing chamber (2), where all cleaning operations of the helmet take place, is supplied with a waterproof gate (17) which is connected thereto. The washing chamber (2) is connected to the brush and spraying mechanism, the wring mechanism (11) and the drying mechanism. The invented washing machine is connected to the water supply through a pipe (4), a water discharge pipe (3) the operation thereof is electronically controlled by an operation control system (14) which is connected to a main server (via a modem).

14 Claims, 9 Drawing Sheets

AUTOMATIC COIN-OPERATED OR ELECTRONIC CARD-OPERATED WASHING MACHINE AND DRYER FOR HELMETS

CROSS-REFERENCE TO RELATED APPLICATIONS

This application is an U.S. national phase application under 35 U.S.C. §371 based upon co-pending International Application No. PCT/GR2009/000030 filed on May 18, 2009. Additionally, this U.S. national phase application claims the benefit of priority of co-pending International Application No. PCT/GR2009/000030 filed on May 18, 2009 and Greek Application No. 20080100328 filed on May 16, 2008. The entire disclosures of the prior applications are incorporated herein by reference. The international application was published on Nov. 19, 2009 under Publication No. WO 2009/138807.

FIELD OF THE INVENTION

The present invention relates to an automatic coin-operated or electronic card-operated washing machine and dryer for helmets, which functions as an automatic and autonomous vending service machine and combines the quick and effective washing of a helmet with the protection of its parts and fittings.

DESCRIPTION OF RELATED ART

Until today there are no similar devices in the prior art. In particular, a bucket with lukewarm water and soap is known, which is usually used for the washing of a helmet. Following that, the helmet is washed out and is allowed to dry in a to place with room temperature.

The main disadvantage of the conventional helmet washing is mainly the long duration of the complete drying time, which, in case the inner parts of the helmet are not detachable and the whole helmet must be washed and dried, can even be up to three days. If said parts are detachable and only the inner case of the helmet must be washed, the washing and drying procedure may take one to two days.

In addition, the conventional washing procedure wears off the inner case of the helmet (due to humidity), which following a number of washings starts to moulder.

SUMMARY OF THE INVENTION

All the above technical problems led the inventor to an attempt to find a solution, the result of which is the object of the present invention.

The washing machine for helmets according to the present invention eliminates all the above disadvantages. In particular, within a few minutes, a perfect helmet wash takes place for the person interested. Furthermore, the invented machine applies to all technical specifications of helmet manufacturers, with regard to the safe washing of the helmet, in order to avoid the occurring of any problems and for the material and the inner case of the helmet not to be harmfully affected.

In addition, one of the most important innovations of the washing machine according to the present invention is that the washing machine is automatic and autonomous and therefore, it can be placed in any location and it can autonomously provide the specific service to the consumers twenty four hours a day and with no human support.

Moreover, the present invention offers the possibility of remote automatic information dispatch to a main server, which can receive and administer information and statistic data for multiple machines, regarding the operation of the machines, the remaining quantity of expendable supplies, possible repair requirement etc. All the above functions are achieved through an electronic control operation system and a GSM modem, so that no internet line for each device is required.

Furthermore, the machine according to the present invention provides more operations, such as sterilization and waxing, which were not possible under the conventional helmet washing procedures.

BRIEF DESCRIPTION OF THE DRAWINGS

The technical, constructional and functional characteristics of the present invention will be comprehensive to those skilled in the art, with reference to the accompanying drawings of the present specification, which show industrial preferred embodiments of the present invention. In particular.

The drawings illustrate an example of the present invention. Hereinafter, the identical reference numbers of the main parts of the object are used for the corresponding parts in the accompanying drawings. The parts are not depicted to scale but simply in dimensions proportional to one another.

DESCRIPTION OF THE PREFERRED EMBODIMENTS

Figure 1:
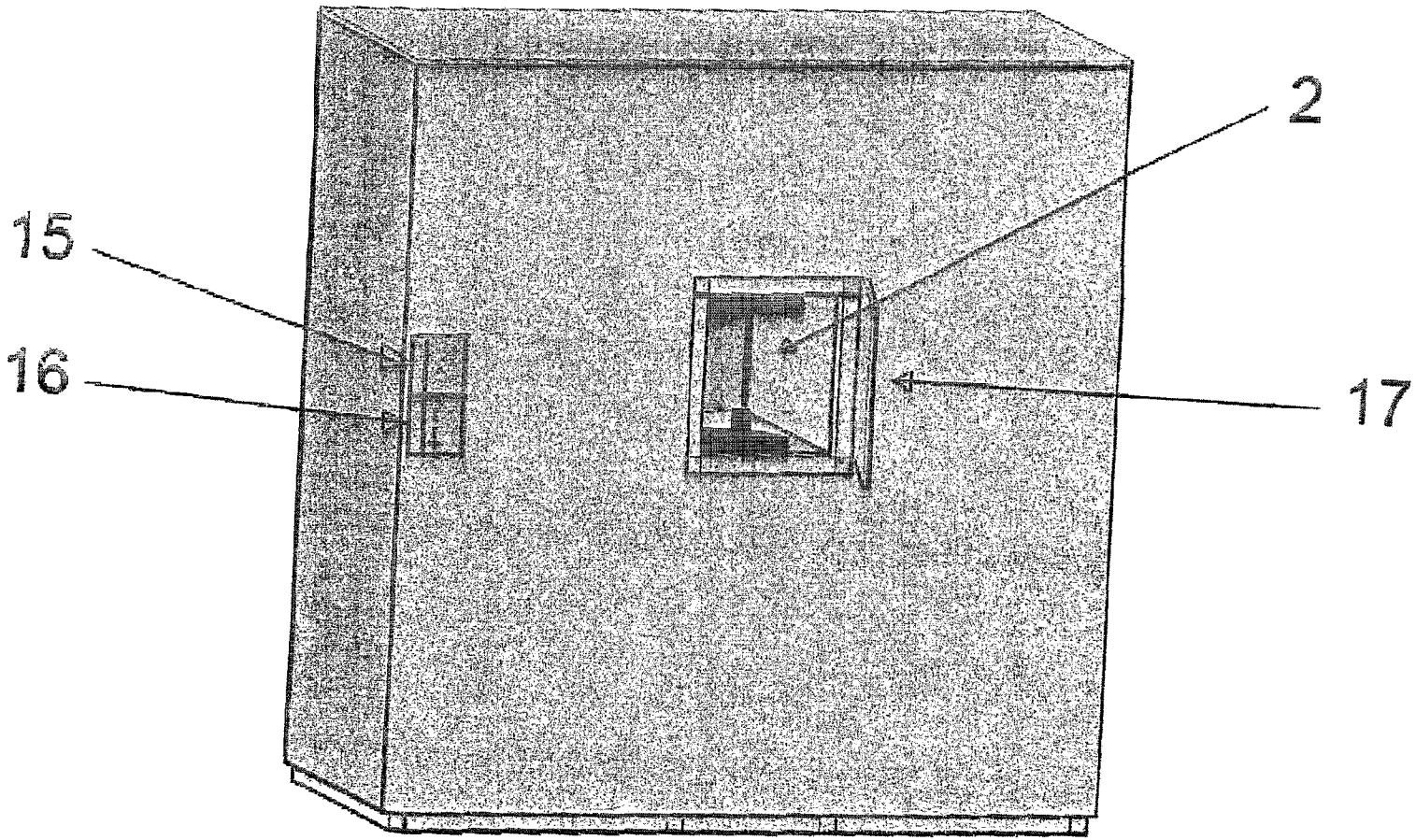
FIG. 1 is a perspective view of the external part of the washing machine according to the invention.
Figure 2:
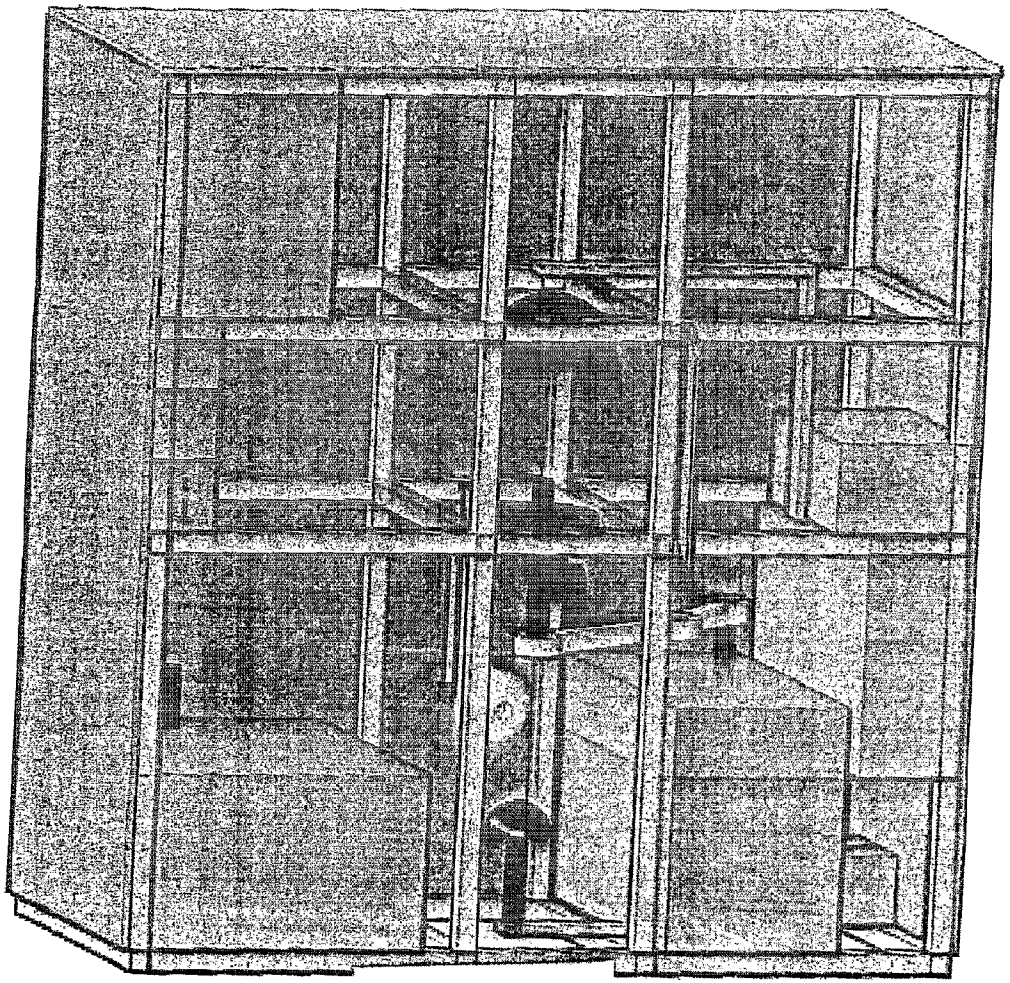
FIG. 2 is a perspective view of the washing machine according to the invention, which has its front part in opened state.
Figure 3:
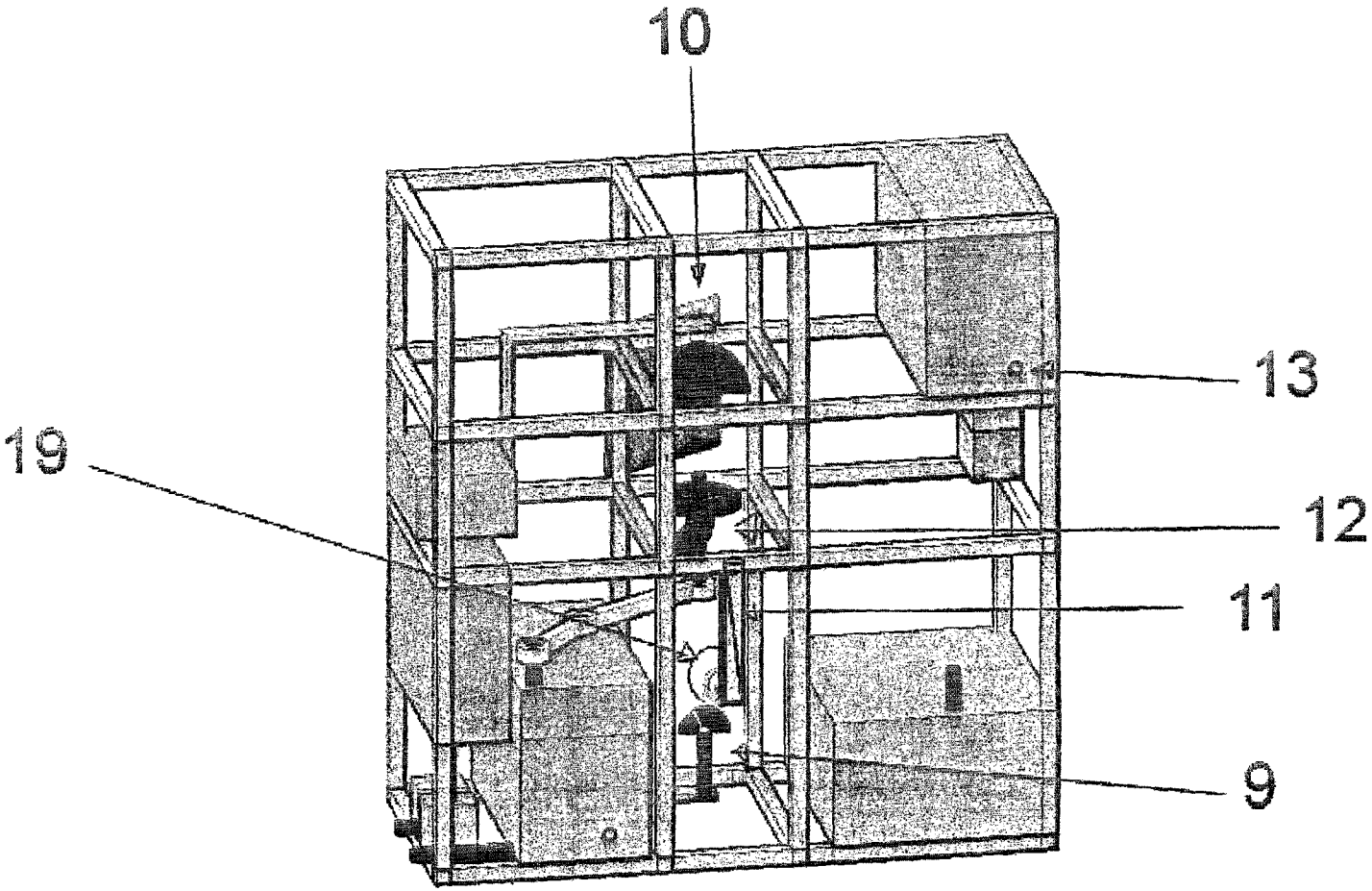
FIG. 3 is a perspective view of the internal part of the washing machine according to the invention.
Figure 4:
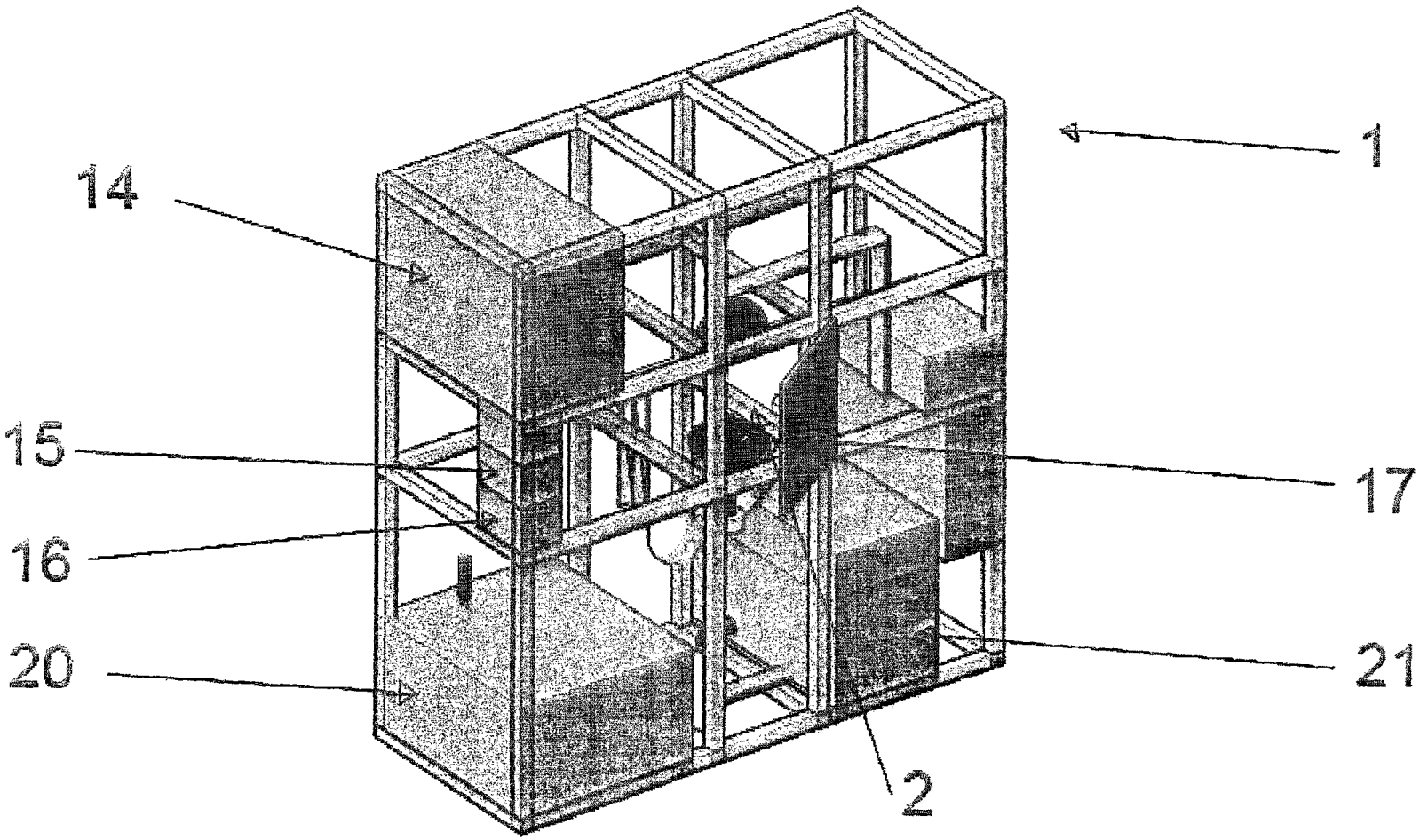
FIG. 4 is a perspective view of the lateral internal part of the washing machine according to the invention.
Figure 5:
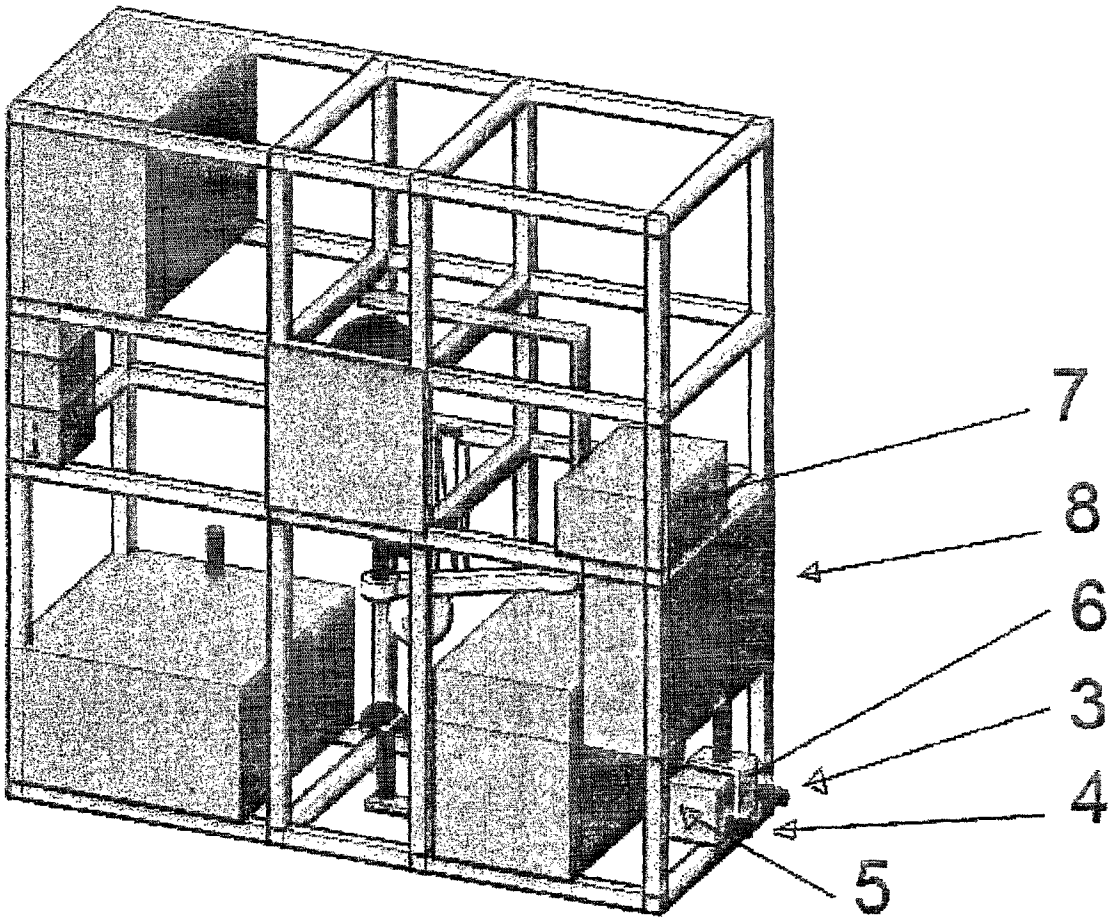
FIG. 5 is a perspective view of another lateral internal part of the washing machine according to the invention.
Figure 6:
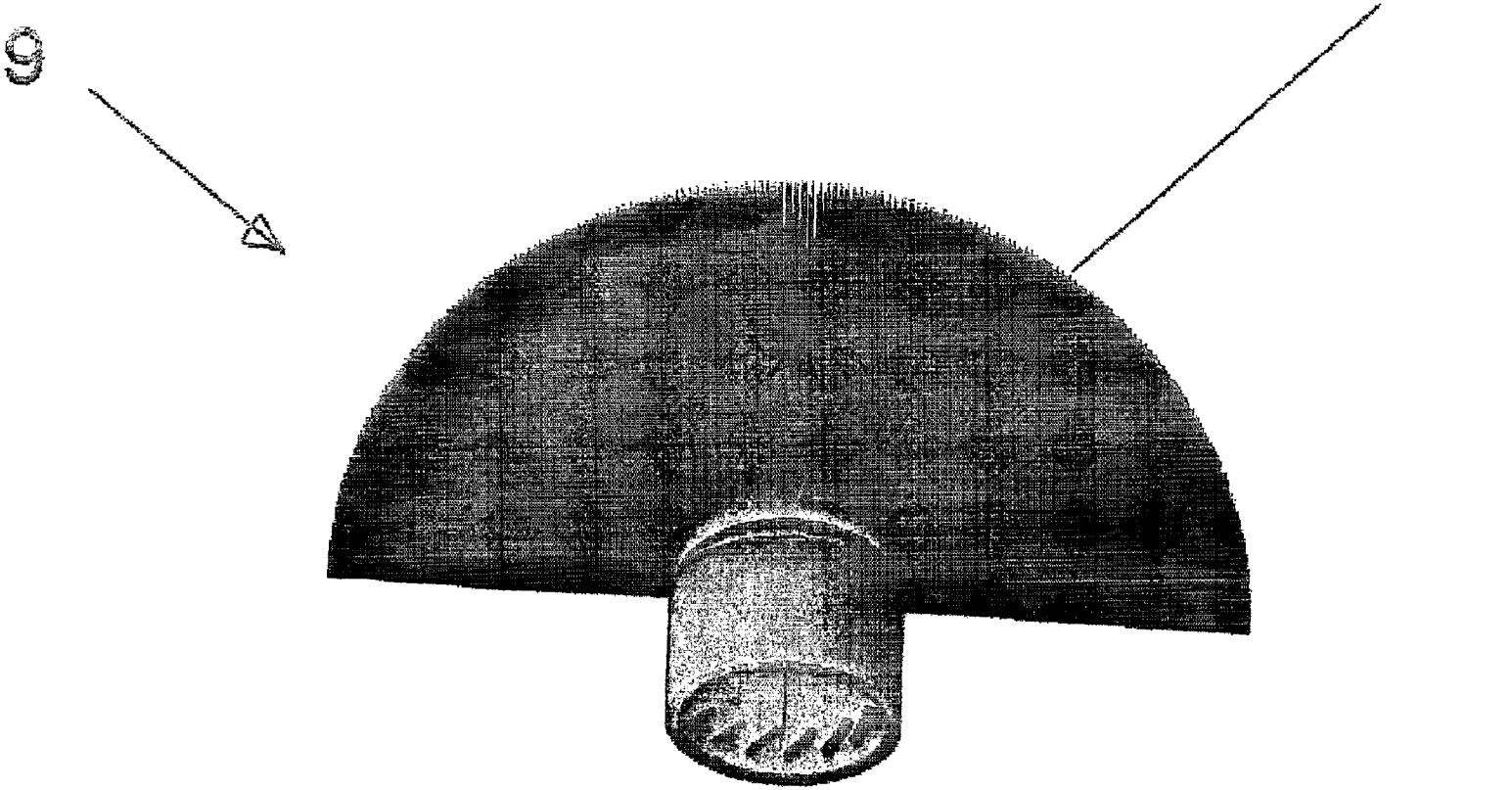
FIG. 6 is a plan view of the brush used for the inner part of the helmet (inner brush).
Figure 7:
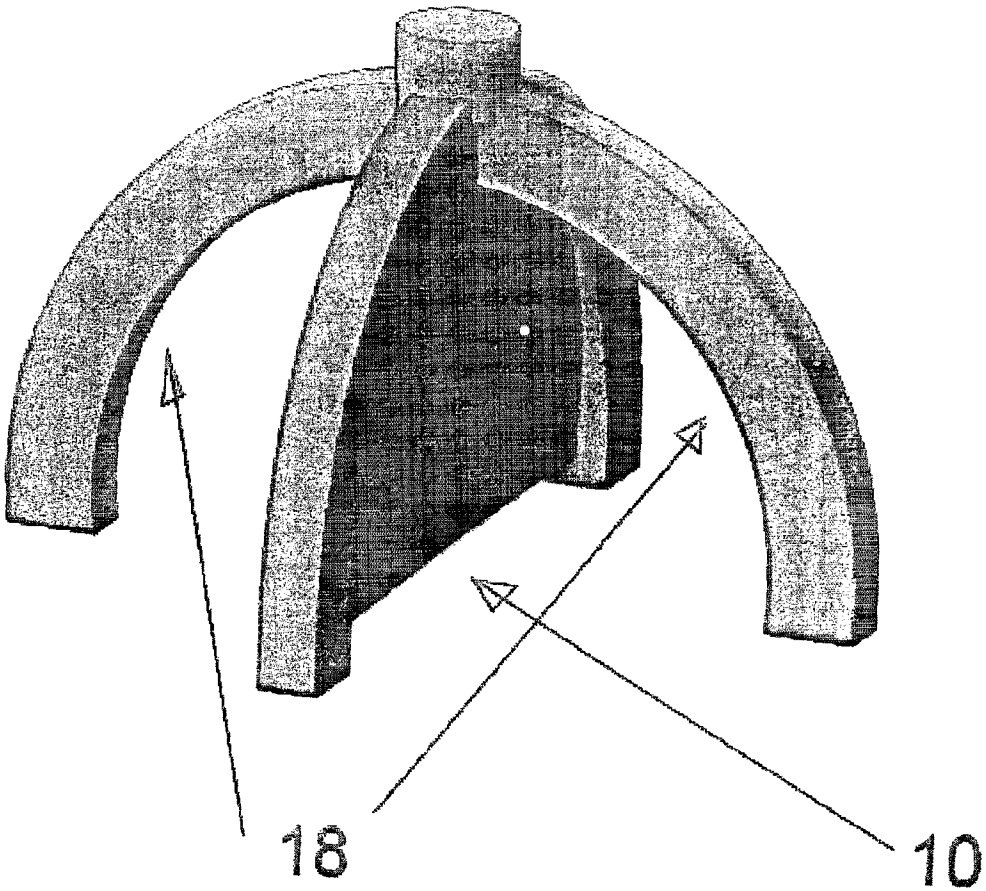
FIG. 7 is a perspective view of the brush used for the external part of the helmet (external brush).
Figure 8:
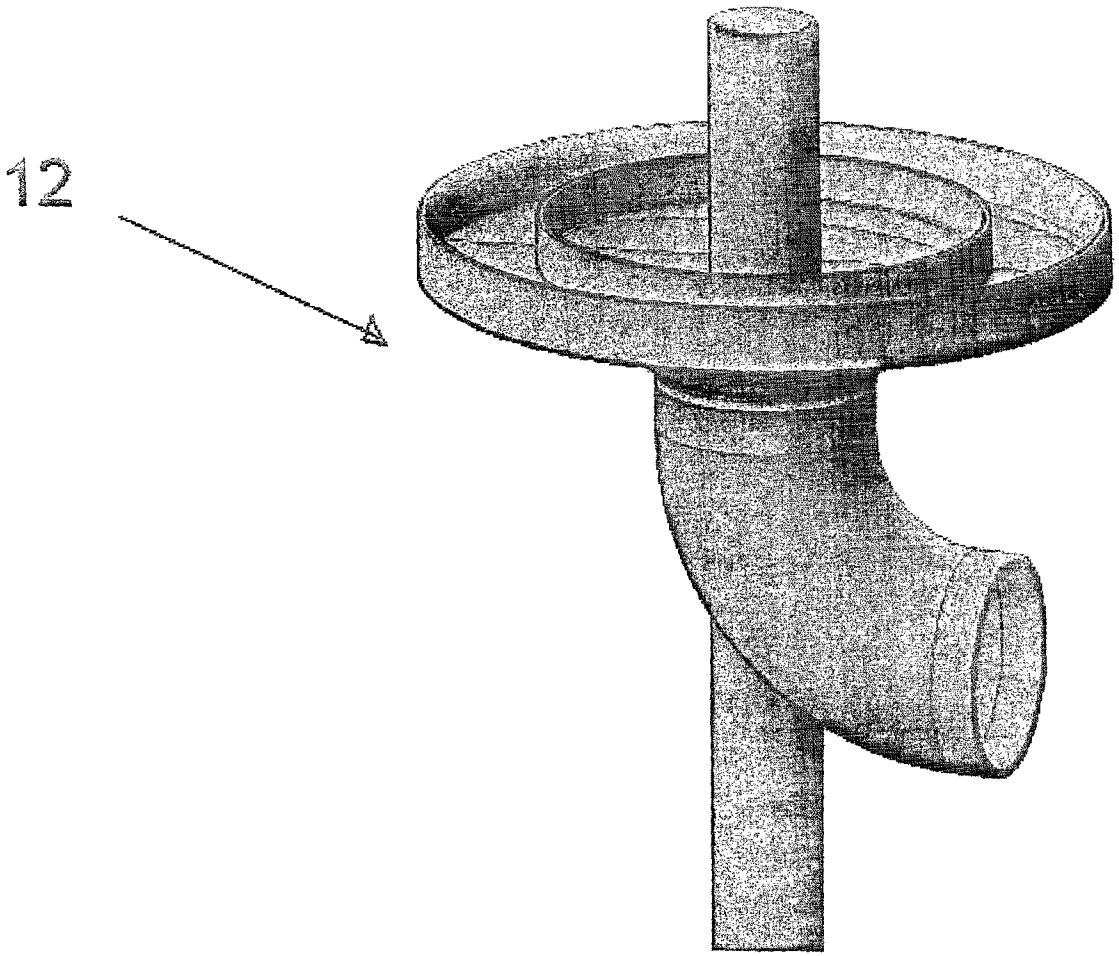
FIG. 8 is a perspective view of the air supply—absorption unit and the liquid discharge unit.
Figure 9:
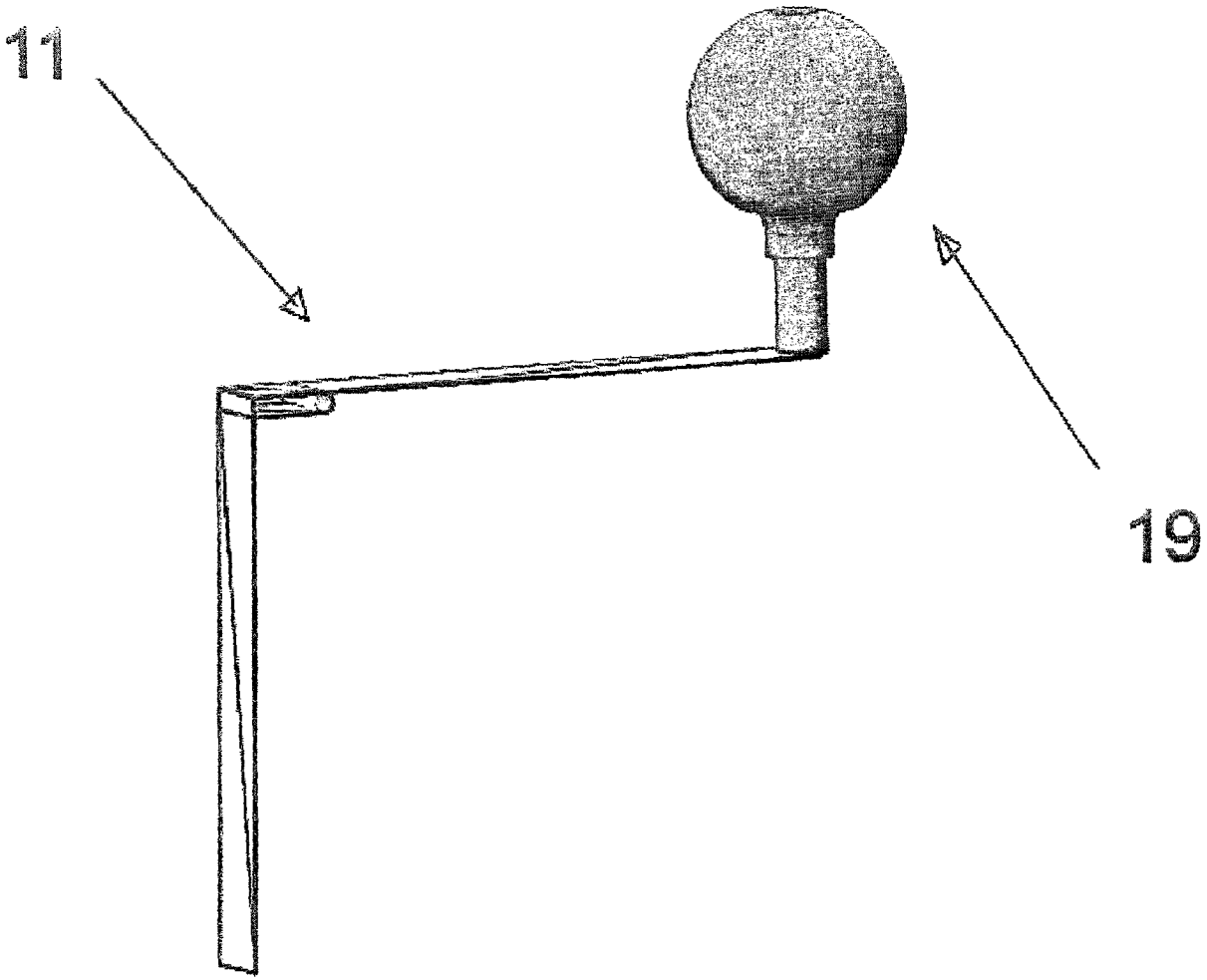
FIG. 9 is a perspective view of the wring mechanism.

The invented washing machine consists of a body 1 where all the structural units of the machine are based and is externally surrounded by a cabin, in which the washing chamber 2 is situated. All cleaning operations of the helmet take place in the washing chamber 2 and it is supplied with a gate 17 which is connected thereto. The washing chamber 2 is connected to the following units:

- The brush and spraying mechanism, which is rotary and consists of the inner brush 9, the external brush 10 and the nozzles 18, which inject the water and the relative detergent.
- The wring mechanism 11, which, after the washing, activates an elastic material 19 which is filled with compressed air and puts pressure on the inner case of the helmet, with the effect of removing most of the water quantity thereof.
- The drying mechanism, which performs the final drying of the helmet, consisting of an air supply and absorption unit 12 and a liquid discharge unit, an air supply motor 21 and a vacuum pump 20. The drying stage is achieved by two parallel and simultaneous operations, according to which the air supply motor 21 provides to the helmet a big volume of pressured air and simultaneously the vacuum pump 20, or a relevant motor, absorbs the water and the humidity remaining after the wring. Due to the above, a continuous flow of air is created in the helmet and as a result an immediate and complete drying is achieved.

The invented washing machine consists of a pipe 4, used for its connection to is the water supply, a water discharge pipe 3, a water supply electrical valve 5 operating electrically allowing, according to the washing stage, the water input to the washing chamber 2, an instantaneous heater 6 heating the water to the desired washing temperature and a pressure water pump 7 which increases the water pressure to the required washing level.

The device is also provided with current supply 13, electric operation control system 14 (main board) and monitor 15 where all the indications and selection buttons used for the operation of the machine are shown. It is also possible for the electric operation control system 14 to be connected, when required, through a GSM modem to a main server, which could receive and administer information and statistic data for more devices, relevant to their operation, the remaining quantity of expendable supplies, a possible repair requirement, etc. A card slot or a coin slot 16 is placed on the external casing—cabin for the insertion of coins or prepaid card by the person interested in order for the machine to initiate its operation.

In order for the invented washing machine to operate, the relevant tariff is inserted in the coin slot 16, or the prepaid card to the respective card slot, for services desired by the customer who is guided through the monitor 15 displaying all the required information. Immediately after the completion of the selections, the electronic operation control system 14 initiates the washing procedure. Firstly, the gate 17 opens in order for the helmet to be placed into the washing chamber 2.

Then, the gate 17 is closed and locked and the rotation of the brushes 9 and 10 commences, removing the dust and small particles from the inner and outer sides of the helmet.

When the above procedure is completed, the electric valve 5 is opened and water of continuous flow is provided to the instantaneous heater 6 in order to reach the desired temperature. When the water reaches the appropriate temperature it is injected to the washing chamber 2 by the nozzles 18. At first only water is injected and then, together with detergent. At the same time the brushes 9 and 10 are being rotated, contributing, together with the water and detergent, to the cleaning of the helmet. As soon as the washing of the helmet is completed, it is being well rinsed with water and then the operation of the system of the rotating brushes 9 and 10 and the nozzles 18 stops and the operation of the wring mechanism 11 begins, which removes most of the water quantity. Then the operation of the drying mechanism 12 starts which totally absorbs the humidity from the helmet.

Finally, the gate 17 is unlocked and the user removes his helmet.

It should also be noted that the object of the present invention should not be limited to the above described example. The accomplishment of this invention is also possible using alternative manufacturing methods, fittings and machinery within the scope of the present invention.

The invention claimed is:

1. An automatic coin-operated or electronic card-operated washing machine and dryer for helmets, said washing machine and dryer comprising:

a body, which is externally surrounded by a cabin, in which a washing chamber is situated;

a gate connected to said washing chamber;

a brush and spraying mechanism, a wring mechanism and a drying mechanism each being connected to said washing chamber, said brush and spraying mechanism being configured to clean an inner and outer part of a helmet received in said washing chamber;

a pipe connectable to said washing machine and dryer, and to a water supply, said pipe being in communication with a water supply electrical valve;

a water discharge pipe;

an instantaneous water heater for heating water to a desired washing temperature level;

a pressure water pump, which increases water pressure to a required washing level;

an electric operation control system and monitor; and at least one of a card slot, and a coin slot, which is placed on an external casing configured to initiate operation of said washing machine and dryer.

2. The automatic coin-operated or electronic card-operated washing machine and dryer for helmets, according to claim 1, wherein said brush and spraying mechanism is rotatable and comprises an inner brush and nozzles configured for cleaning the inner part of the helmet, an outer brush (10) and nozzles configured for cleaning the outer part of the helmet said nozzles being configured to inject the water and a relevant detergent.

3. The automatic coin-operated or electronic card-operated washing machine and dryer for helmets, according to claim 1, wherein said wring mechanism activates an elastic material filled with pressured air and is configured to press an inner case of the helmet, removing most of the water quantity thereof.

4. The automatic coin-operated or electronic card-operated washing machine and dryer for helmets, according to claim 1, wherein said drying mechanism, which performs a final drying of the helmet, consists of an air supply and absorption unit and a liquid discharge unit, an air supply motor and a vacuum pump, a drying stage is achieved by at least one of two parallel and simultaneous operations, according to which said air supply motor provides to the helmet a volume of pressured air and simultaneously said vacuum pump absorbs the water and humidity remaining after a wring operation by said wring mechanism.

5. The automatic coin-operated or electronic card-operated washing machine and dryer for helmets, according to claim 1, wherein said electric operation control system is connected through a GSM modem to a main server, said electric operation control system being configured to at least one of send, receive and administer information and statistic data for more devices, relevant to operation of said devices, collected cash, remaining quantity of expendable supplies, and a possible repair requirement.

6. A method for operating an automatic coin-operated or electronic card-operated washing machine and dryer for helmets said method comprising the following steps:

a) inserting one of a relevant tariff in a coin slot, and a prepaid card to a respective card slot, for a service desired by a user who is guided through a monitor;

b) initiating a washing procedure by an electronic operation control system and opening a gate in order for a helmet to be placed into a washing chamber;

c) closing and locking the gate;

d) rotating brushes so as to clean an inner and outer side of the helmet;

e) removing dust and small particles from the inner and outer sides of the helmet;

f) opening an electric valve and providing water of continuous flow to an instantaneous heater in order to reach a desired temperature;

g) injecting the water when the water reaches the desired temperature to the washing chamber by nozzles;

h) initiating a washing wherein at first only water is injected and then, water together with detergent and concurrently the brushes are being rotated, contributing, together with the water and detergent, to the cleaning of the helmet;

i) rinsing the helmet with water when the washing of the helmet is completed, and the operation of the rotating brushes and the nozzles stops;

j) initiating a wring mechanism, which removes a water quantity;

k) absorbing humidity from the helmet by a drying mechanism; and l) unlocking the gate and removing the helmet.

7. A helmet washing and drying device comprising:

a body externally surrounded by a cabin;

a washing chamber located in said cabin, said washing chamber being configured to receive a helmet;

a gate operably connected and lockable to said washing chamber, said gate being configured to allow the helmet to be placed in said washing chamber;

a brush and spraying mechanism in operable communication with said washing chamber said brush and spraying mechanism having at least one inner brush including at least one nozzle, and at least one outer brush including at least one nozzle, said nozzle of said inner and outer brush being configured to spray liquid on an inner and outer part of the helmet respectively, said inner brush and outer brush being configured to clean said inner and outer part of the helmet respectively;

a wring mechanism in operable communication with said washing chamber, said wring mechanism being configured to activate an elastic material which is filled with compressed air, said elastic material being configured to put pressure on an inner case of the helmet;

a drying mechanism in operable communication with said washing chamber, said drying mechanism having at least one of an air supply and absorption unit, an air supply motor, and a vacuum pump, said air supply motor being configured to provide to the helmet a volume of pressured air, said vacuum pump being configured to absorb the liquid sprayed by said nozzle of said inner and outer brush;

a water heater for heating the liquid to a desired temperature level; and at least one payment receiving slot configured to initiate operation of said helmet washing and drying device.

8. The helmet washing and drying device according to claim 7, wherein said liquid is at least one of water, and detergent.

9. The helmet washing and drying device according to claim 8 further comprising a pipe connected to a water supply, a water discharge pipe, and a water supply electrical valve configured to allow said liquid to input to said water heater.

10. The helmet washing and drying device according to claim 8 further comprising a pressure water pump configured to increase water pressure to a predetermined washing pressure level.

11. The helmet washing and drying device according to claim 8 further comprising a current supply, an electric operation control system, and a monitor.

12. The helmet washing and drying device according to claim 8, wherein said inner brush and outer brush are each rotatable.

13. The helmet washing and drying device according to claim 8, wherein said drying mechanism is configured to perform a drying stage achieved by at least one of two parallel and simultaneous operations, according to which said air supply motor provides to the helmet the volume of pressured air and simultaneously said vacuum pump absorbs said liquid remaining after a wring operation by said wring mechanism.

14. The helmet washing and drying device according to claim 8, wherein said electric operation control system is connected through a GSM modem to a main server, said electric operation control system being configured to at least one of send, receive and administer information and statistic data.

* * * * *